US006394970B1

(12) United States Patent
Maier

(10) Patent No.: US 6,394,970 B1
(45) Date of Patent: May 28, 2002

(54) DRIVE ARRANGEMENT FOR A MASSAGE CHAIR

(75) Inventor: Eugen Maier, Bad Grönenbach-Ittelsburg (DE)

(73) Assignee: Firma Krautmann & Maier, Ungerhausen (DE)

( * ) Notice: Subject to any disclaimer, the term of this patent is extended or adjusted under 35 U.S.C. 154(b) by 0 days.

(21) Appl. No.: 09/474,029

(22) Filed: Dec. 28, 1999

(30) Foreign Application Priority Data

Dec. 28, 1998 (DE) ..... 298 23 109 U

(51) Int. Cl.[7] ..... A61H 19/00

(52) U.S. Cl. ..... 601/99; 601/98; 601/101; 601/103; 601/115; 601/116

(58) Field of Search ..... 601/97, 98, 99, 601/101, 102, 103, 115, 116, 122, 126

(56) References Cited

U.S. PATENT DOCUMENTS

| | | | | |
|---|---|---|---|---|
| 4,009,716 A | | 3/1977 | Cohen | 128/218 |
| 4,422,449 A | * | 12/1983 | Hamabe | 601/102 |
| 5,233,973 A | | 8/1993 | Gill et al. | 128/33 |
| 5,464,382 A | | 11/1995 | Wang | 601/99 |
| 5,792,080 A | * | 8/1998 | Ookawa et al. | 601/99 |
| 6,083,181 A | * | 7/2000 | Marcantoni | 601/99 |

FOREIGN PATENT DOCUMENTS

| | | | | |
|---|---|---|---|---|
| CH | 672884 A5 | | 1/1990 | |
| DE | WO-98/03144 | * | 1/1998 | A61H/15/00 |
| WO | WO98/57611 | | 12/1998 | |

* cited by examiner

*Primary Examiner*—Michael A. Brown
*Assistant Examiner*—Benjamin K. Koo
(74) *Attorney, Agent, or Firm*—Jacobson Holman, PLLC

(57) ABSTRACT

A drive arrangement for a massage chair, in which massage elements, for example massage rollers, are movable in various directions, with at least one drive shaft for the massage elements, which are driven by electric motors. The electric motors are set onto the end of the shafts.

10 Claims, 3 Drawing Sheets

DRIVE ARRANGEMENT FOR A MASSAGE CHAIR

BACKGROUND OF THE INVENTION

The invention relates to a drive arrangement for a massage chair, in which massage elements, for example massage rollers, are movable in various directions, with at least one drive shaft for the massage elements, which are driven by electric motors.

Massage chairs are known which have in the rear wall of the chair a drive arrangement of the general type set out above. In this case the massage rollers are as a rule disposed in pairs and we moved in various directions by an eccentric drive and by tumbling arrangements in order to exert a massaging effect on the person sitting in the chair.

Since as a rule the massage rollers are disposed symmetrically with respect to the median plane of the massage chair, electric motors are built into the drive arrangements so that the massage rollers are driven substantially in the same manner. However this has the disadvantage that when a defective motor is replaced the drive arrangement must be largely dismantled.

BRIEF SUMMARY OF THE INVENTION

The object of the invention is to make fiber developments to the known drive arrangement in such a way that repairs can be carried out quickly and at low cost.

In order to achieve this object the invention takes as its starting point a drive arrangement of the general type set out in the introduction, i.e. a drive arrangement for a massage chair, in which massage elements, for example massage rollers, are movable in various directions, with at least one drive shaft for the massage elements, which are driven by electric motors. According to the invention it is proposed that the electric motor is set indirectly or directly onto the end of the drive shaft.

The principal achievement in the arrangement according to the invention is that in the case of repair to the electric motor disassembly of the drive arrangement is unnecessary in practice. The electric motor set onto the end of the drive shaft can be taken off after a few simple fixing means have been released and can be replaced by another motor.

In general it is recommended that the electric motors with their reduction gears, for example bevel gears, be constructed in such a way that these components can be set onto the ends of the drive shafts. However, it is also possible to design the arrangement so that only the electric motor is replaceable, in which case the gear is, if appropriate, part of the drive arrangement.

The invention can be applied advantageously even to a single drive shaft. As a rule, however, two drive shafts are provided. In this case the invention proposes that the two electric motors can be set indirectly or directly onto hie ends of the shafts. In special constructions, however, more than two drive shafts may be provided, in which case the arrangement of the electric motors takes place in an appropriate manner.

If the drive elements for the massage rollers are assembled in a drive frame, then it is recommended that the electric motor or motors be set onto the outer face or onto the outer faces of the drive shaft.

In particular the invention proposes that the drive frame consists of two plates which are connected to one another by bars, wherein these plates also serve for mounting of the drive shafts. In this construction the electric motors are each disposed on the outer faces of the plates.

In his case the electric motors can be provided on one face of the bearing frame. However, it is better if in the case of two electric motors one motor is disposed on each outer face of the bearing frame. In this way the electric motors are easily accessible and the total space required nevertheless remains small.

The electric motors are in particular aligned parallel to the plates. In a preferred embodiment of the invention it is provided that the electric motors are aligned on the outer faces of the bearing plates substantially parallel to one another but towards one another. As a rule the drive shafts for the massage rollers have a spacing between them which is utilised for the arrangement of the electric motors.

For the connection between the ends of the drive shafts and the electric motors or the pertaining gears, the invention provides in particular a push-in coupling. A push-in coupling can be obtained for example by constructing the shaft with a polygonal end which then engages in a corresponding recess in the drive shaft of the gear or of the electric motor. It is clear that the two coupling parts can also be disposed the other way round.

A star-like toothing can also be provided between the two elements which are to be connected to one another. The use of a dog coupling or similar means is also possible.

The electric motor can be fixed, on the drive frame in various ways. In special cases it is already, sufficient to provide a connection secured by latching elements between the two coupling parts, as well as a support arrangement for the electric motor to take up the restoring moment. In general, however, it is recommended to provide some screws between the electric motor and the drive frame.

In place of a push-in coupling, a coupling of a different construction can also be provided with the invention. Thus, transverse pins can also be used which simultaneously constitute entraining elements and fixing means.

In a further embodiment of the invention it is provided that the drive frame as a whole is adjustable in height and the drive for this is set onto one end of the shaft. Thus, according to the invention this electric motor is also fixed by setting it on, so that in this connection too the repair only takes a short time.

DETAILED DESCRIPTION OF PREFERRED EMBODIMENTS

Figure 1:
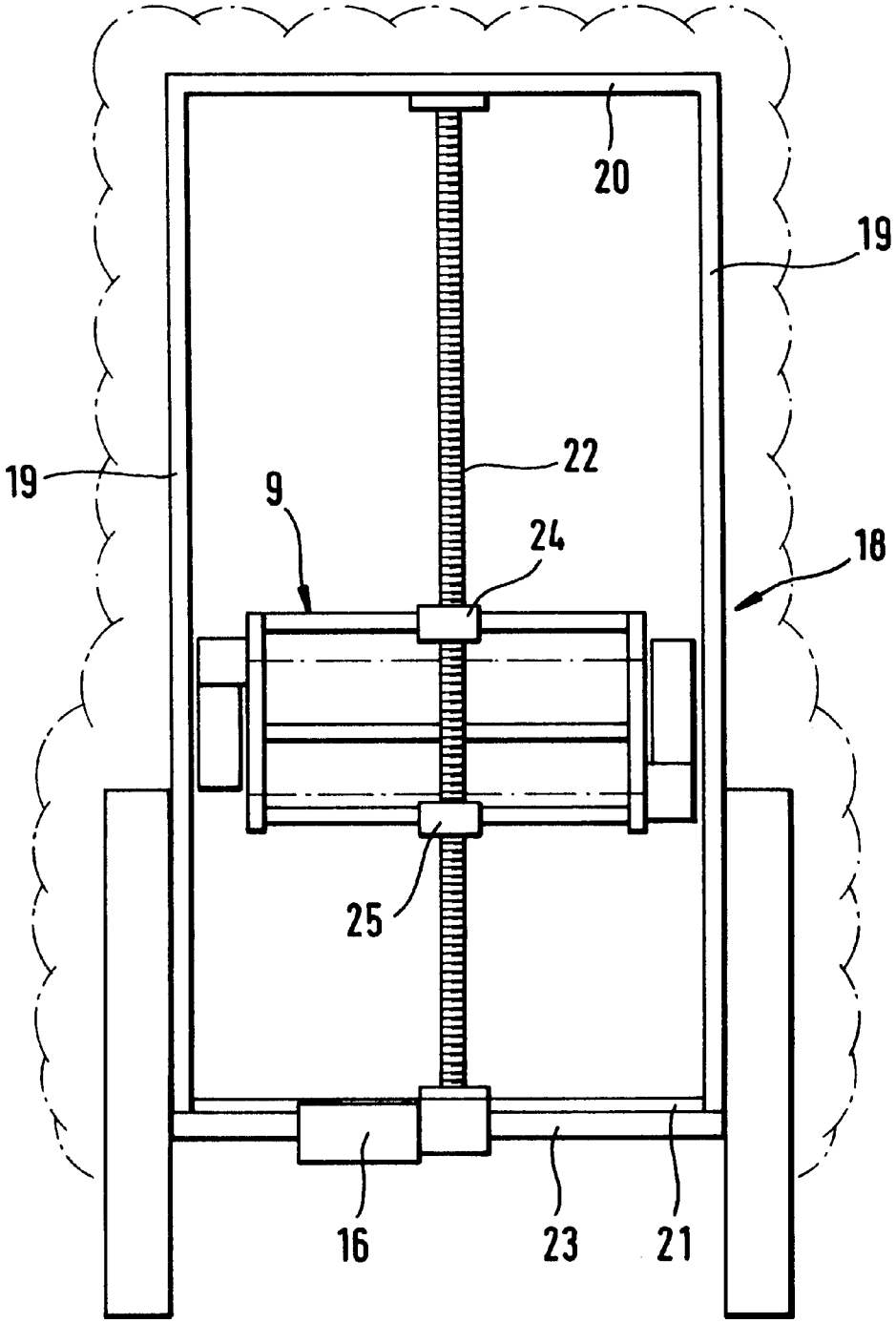
FIG. 1 shows a rear view of the frame of a massage chair according to the invention.

The massage chair 18 shown schematically in FIG. 1 has a frame 19 which is substantially associated with the back rest. The upholstery is not shown in detail.

Figure 2:
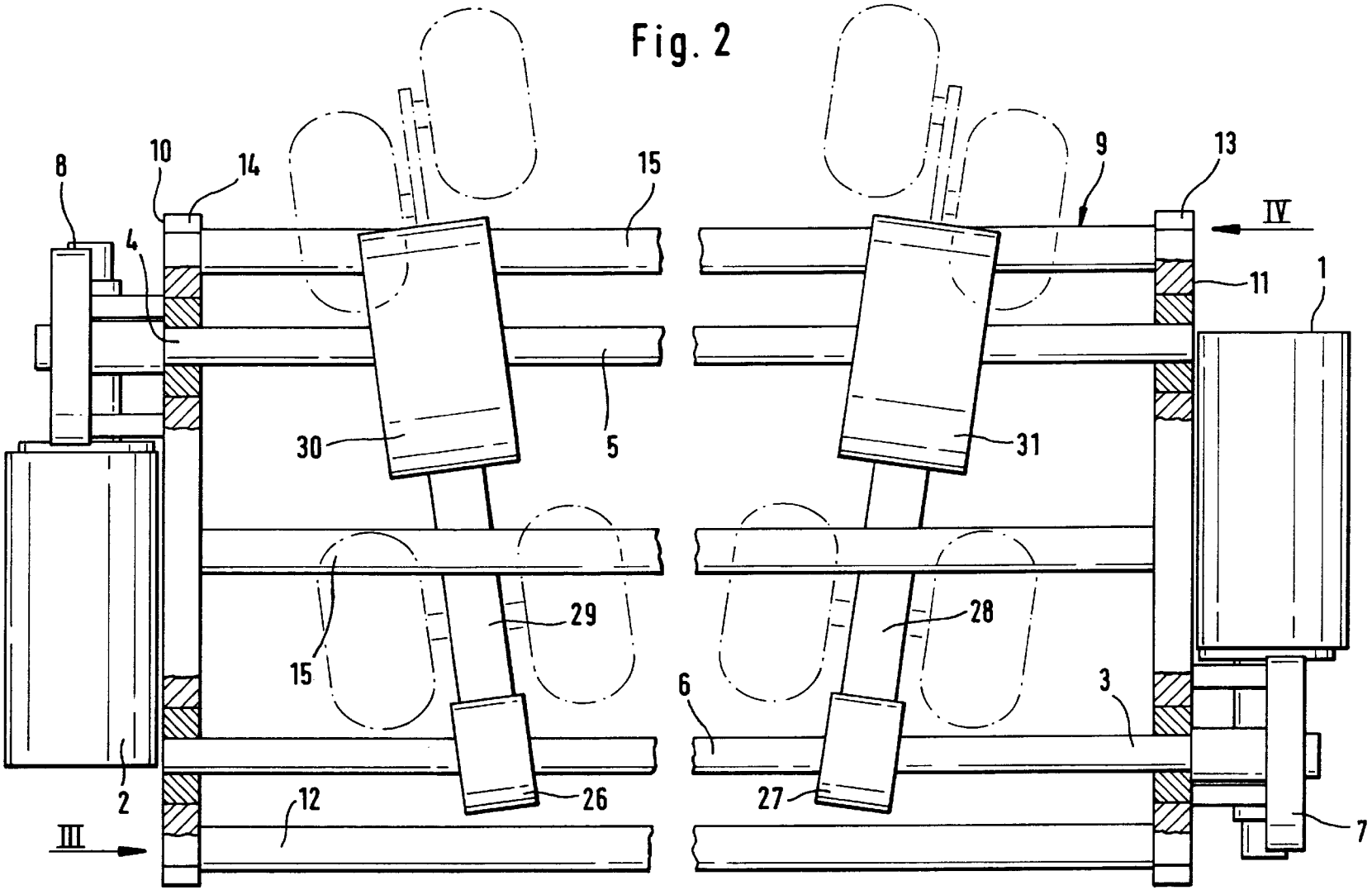
FIG. 2 shows a representation of the drive arrangement on a different scale.

A screw spindle 22 extends between the transverse members 20 and 21 of the frame 19, and the drive 16 acts on the lower end of the screw spindle. This drive 16 is mounted on the fame part 23. The drive frame 9 is guided on the frame 19 on guide elements which are not shown in detail and is adjustable in height by means of the screw spindle 22. For this purpose spindle nuts 24 and 25 are provided which raise or lower the drive frame 9 on rotary motion of the screw spindle 22. The details of the drive frame 9 are shown in particular in the representations according to FIGS. 2 to 4.

The drive frame 9 is substantially formed by the plates 13 and 14 which are connected to one another by the bars 12 and 15. The drive shafts 5 and 6 are rotatably mounted in the drive frame 9 thus formed. In this case the drive shaft 5 has on the left-hand end 4 as seen in the drawing a protecting lug which is not shown in detail and which co-operates with the reduction gear 8 of the electric motor 2.

In a similar manner the drive shaft 6 has on its right-hand end 3 a projecting lug which is in drive connection with the reduction gear 7 of the electric motor 1. The further connecting means between the electric motors 1 and 2 and respectively the reduction gears 7 and 8 and the plates 13 and 14 are not shown in detail.

The shaft 6 bears two eccentrics which drive the eccentric bearings 26 and 27. These eccentric bearings are connected to push rods 28 and 29 and act on levers which are not shown in detail and which are set onto the tumbling plates 30 and 31. These tumbling plates are borne by the shaft 5 and produce movements in the axial direction of the shaft 5. The aforementioned levers on which the push rods 28 and 29 act bear the massage rollers (not shown) which act on the back of the user of the chair.

Figure 3:
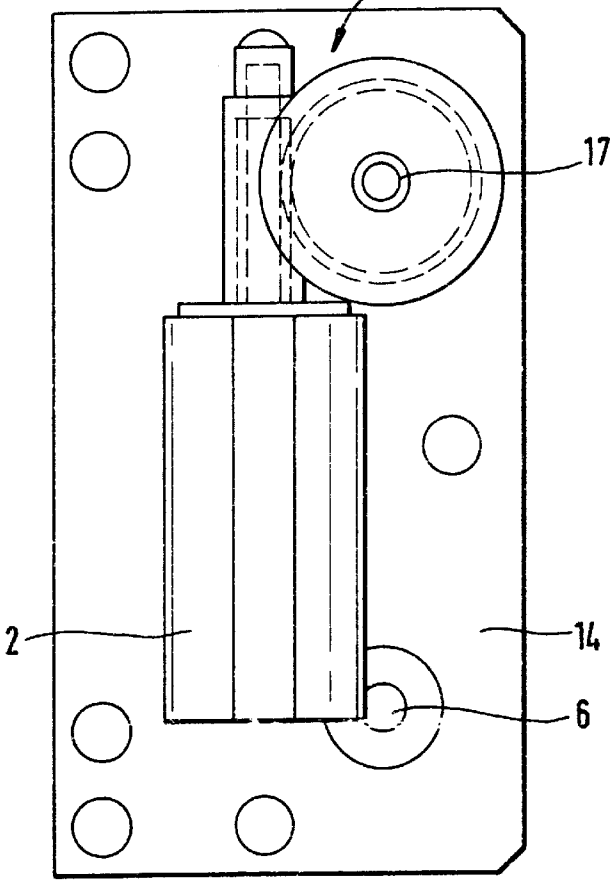
FIG. 3 shows a side view of the representation of FIG. 2 in the direction of the arrow III—III.
Figure 4:
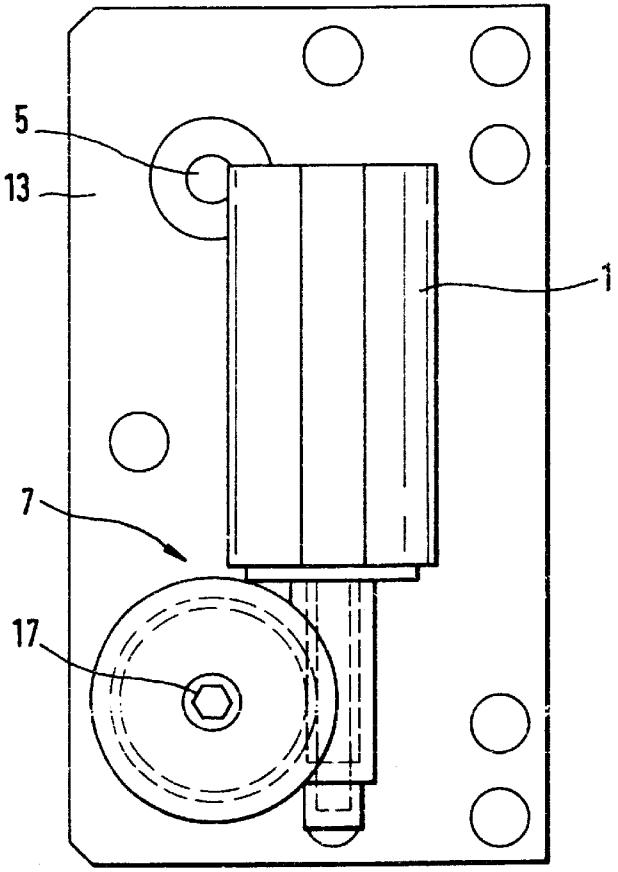
FIG. 4 shows a side view of the representation of FIG. 2 in the direction of the arrow IV—IV.

The representations according to FIGS. 3 and 4 reveal that for example in the embodiment according to FIG. 3 the push-in coupling 17 is constructed as a hexagon and co-operates with a corresponding hexagonal construction of the end 4 of the shaft 5. In the embodiment according to FIG. 4 the corresponding push-in coupling 17 is constructed as a star toothing which is not shown in detail.

It is clear that the electric motors 2 and 1, which are disposed respectively on the outer faces 10 and 11 of the plates 14 and 13, or the appertaining reduction gears 8 and 7 respectively are easily replaceable in the event of a defect. They merely need to be pulled off outwards. Disassembly of the individual parts of the drive frame 9 is not necessary.

The arrangement of the drive 16 and its connection to the lower end of the screw spindle 22 is designed in the same way.

It should be understood that the foregoing description of the invention is attended merely to be illustrative thereof and that other embodiments modifications and equivalents may be apparent to those skilled in the art without departing from its spirit.

What is claimed is:

1. A drive arrangement for a massage chair, comprising a frame, massage elements movable in a plurality of directions, and two separate drive shafts mounted inside of said frame for moving the massage elements, each of said separate drive shafts being driven by a separate electric motor, both of said separate electric motors being mounted exteriorly of the frame on opposite exterior sides of the frame for easy removal and replacement of the separate electric motors and said separate electric motors being coupled with a respective end of said two separate drive shafts extending through said frame.

2. A drive arrangement according to claim 1, wherein said electric motors have a reduction gear set onto an end of said two drive shafts.

3. A drive arrangement according to claim 2, wherein said reduction gear is a bevel gear.

4. A drive arrangement according to claim 1, wherein two drive shafts are provided with electric motors coupled with a respective end of the two drive shafts.

5. A drive arrangement according to claim 1, wherein said frame consists of two plates which are connected by bars and bear the two drive shafts, the electric motors being disposed on outer faces of said plates.

6. A drive arrangement according to claim 1, wherein said frame consists of two plates and the electric motors are aligned parallel to said plates.

7. A drive arrangement according to claim 1, wherein said frame consists of two plates and the electric motors are aligned on outer faces of said plates substantially parallel to one another and extending in opposite directions.

8. A drive arrangement according to claim 1, wherein a coupling between said electric motors and said drive shafts is a push-in coupling.

9. A drive arrangement according to claim 1, wherein the frame is adjustable in height within an exterior frame by a drive spindle connected to said frame, said drive spindle having a drive located exteriorly of said exterior frame for ease of replacement.

10. A drive arrangement according to claim 1, wherein said massage elements are massage rollers.

* * * * *